United States Patent [19]

Ketteringham

[11] Patent Number: 4,742,648

[45] Date of Patent: May 10, 1988

[54] DRILL SHARPENING TOOL

[76] Inventor: Thomas Ketteringham, 15 Church View Rd., Probus, Cornwall, England

[21] Appl. No.: 86,206

[22] Filed: Aug. 17, 1987

Related U.S. Application Data

[63] Continuation of Ser. No. 894,737, Aug. 11, 1986, abandoned, which is a continuation of Ser. No. 673,893, Nov. 21, 1984, abandoned.

[51] Int. Cl.[4] ..... B24B 3/24

[52] U.S. Cl. ..... 51/98.5; 51/102; 51/219 PC

[58] Field of Search ..... 51/98.5, 102, 103 C, 51/125.5, 219 R, 219 PC; 279/1 ME, 1 DA, 32, 41 R, 41 A, 42, 43, 47, 48, 52, 53

[56] References Cited

U.S. PATENT DOCUMENTS

| | | | |
|---|---|---|---|
| 1,674,224 | 6/1928 | Rabut | 51/219 R |
| 2,109,308 | 2/1938 | Adams | 51/219 PC |
| 2,124,093 | 7/1938 | Wells | 51/219 PC |
| 2,881,006 | 4/1959 | Amiet | 279/53 |
| 2,958,167 | 11/1960 | Mueller | 51/219 PC X |
| 4,001,975 | 1/1977 | Bernard et al. | 51/219 PC X |
| 4,016,685 | 4/1977 | Moores et al. | 51/219 R |
| 4,483,104 | 11/1984 | Welliver | 51/219 R |

FOREIGN PATENT DOCUMENTS

| | | | |
|---|---|---|---|
| 0007887 | 2/1980 | European Pat. Off. | 279/43 |

*Primary Examiner*—Robert P. Olszewski

*Attorney, Agent, or Firm*—Gifford, Groh, VanOphem, Sheridan, Sprinkle and Dolgorukov

[57] ABSTRACT

A twist drill sharpening tool comprises a body housing a cylindrical rotatable grindstone with a small diameter and longer axis, and a drill holder which can be fitted into a bore in the body so as to hold the tip of a twist drill in contact with the curved surface of the grindstone at a position which is offset from the centreline and inclined at between 10° and 12° from a diametral plane of the grindstone passing through the drill tip contact line with the grindstone. A face cam is engaged by a cam follower of the drill holder so as to vary the projection distance of the drill as it is turned, carried by the holder, around its own axis. The bore for the drill holder may be formed in part of the body which can be moved to different positions to vary the drill tip angle.

16 Claims, 6 Drawing Sheets

DRILL SHARPENING TOOL

This is a continuation of co-pending application Ser. No. 894,737 filed on Aug. 11, 1986, now abandoned, which is a continuation of co-pending application Ser. No. 673,893 filed on Nov. 21, 1984, now abandoned.

BACKGROUND OF THE INVENTION

The re-sharpening of twist drills presents many difficulties both for professional engineer and amateur alike. The main problem lies in the complex shape of the twist drill tip which is rarely fully understood.

Although a twist drill appears at a casual glance to be no more than a rod-like body with helical flutes, the precise configuration is in fact much more complex than this; the twist drill tip, in particular, has a shape which can only be appreciated by careful study. For example, the "pointed" end of the tip is in fact a chisel edge and the generally conical "lands" on either side of this are neither flat nor cylindrically curved but should have a curving inclination from the cutting edge to the trailing edge with respect to a plane perpendicular to the drill axis and a curvature which varies radially of the tip to approximate a conical surface.

Various drill sharpening tools are known in the prior art. In one such known tool there are provided guides operable to grind "flats" on the end faces of the drill by running the drill along a flat grindstone; this is largely unsatisfactory, however, since the tip end surfaces should be curved. Another known device acts to hold the drill in a required orientation about its axis, and to sweep the tip of the drill about an axis inclined at an acute angle to the longitudinal axis of the drill whilst passing the tip end surface of the drill across a flat or curved grindstone surface. The fundamental disadvantage of this arrangement lies in the fact that the two "lands" of the drill tip surface are separated by a chisel edge and are effectively independent. By grinding the two "lands" separately the problem arises of longitudinally aligning the drill sufficiently accurately for both "lands" to be ground symmetrically with respect to the longitudinal axis of the drill. A recent example of a drill grinding tool of the former type is discussed in British Patent No. 1,468,327 granted to Robert Bosch GmbH. In the Bosch drill grinding tool a cylindrical grindstone is carried in a holder which has an extension forming a plate-like housing extension which is supported on a web. The outer surface of the housing extension forms a guide plane for a guiding device consisting of a supporting carriage which serves for guiding a drill to be ground during the grinding procedure. The supporting carriage has a slide block which can be longitudinally guided in a guide machined in the plate-like housing extension, this guide being made in the form of a straight slot in the housing extension extending parallel to the axis of the grinding spindle. The supporting carriage carries a rectilinear V-section groove in which the drill to be ground is inserted during the grinding procedure, the drill being held fast by hand and pressed against the curved surface of the grinding wheel whilst the carriage is moved along the recrtilinear guide. This grinds a concave cylindrical surface on the drill tip on one side of the chisel edge and the drill must be repositioned to drill the other land. It is apparent that the concavely curved land surface formed by this apparatus in no way resembles the correct shape for a drill tip, and it is clear that the Bosch drill grinding jig can only be used for drills having a hard metal insert such as are used for drilling masonry, the insert being subsequently bevelled after the grinding operation discussed above.

A later attempt to produce a drill grinding jig capable of forming a more accurate drill tip surface resulted in the grant of British Patent No. 1,526,169 to Robert Wolff. In Mr. Wolff's drill grinding jig a stand is clamped onto a rest which has two hooks which enclose a grinding wheel. A twist drill to be sharpened is carried in a channel in a holder which is pivoted to a support clamped to the housing with respect to which the grindstone turns. The pivot axis about which the holder turns may be parallel to the grindstone axis or inclined thereto at a predetermined angle, and the pivot axis about which the drill is turned is offset from the axis of the drill and perpendicular thereto so that as the carriage is turned about its pivot axis the tip of the drill is swept across the curved surface of the grindstone. Once one land has been ground in this way it is necessary to remove the drill from the holder, reposition it with the other cutting edge horizontal and perform a new sweep by swinging the drill holder about its pivot axis.

Because the two lands are ground independently it is not possible accurately to set the drill so that both cutting edges will be exactly symmetrical. It will be appreciated that since the flutes of a twist drill are helical, any removal of material from the drill tip will result in the land being shifted angularly as well as axially so that the original setting of the cutting edge parallel to the grindstone axis (or horizontally assuming that the grindstone runs on a horizontal axis) will result in a cutting edge which is inclined to the horizontal to a greater angle the more material is removed from the land during sharpening. Unless exactly the same amount of material is removed from each land then the offset of the cutting edge from its intended position will be different for each land. Further, the Wolff device does not act to cut the correct pseudo-conical surface to the drill tip, but cuts a purely cylindrical surface having a radius of curvature determined by the offset of the pivot axis of the drill holder from the drill tip itself, and this means that the variation in the "fall" or clearance between the leading and trailing edges of the cutting land is not obtained.

OBJECTS OF THE INVENTION

It is a primary object of the present invention to provide a drill grinding tool which is capable of accurately grinding both lands of a drill tip to the same shape and configuration.

It is another object of the present invention to provide a drill grinding tool which is simple to operate and requires no skill in setting up.

It is a further object of the invention to provide a drill grinding tool in which drill grinding is effected by turning the drill about its own longitudinal axis.

Yet another object of the invention is to provide a drill grinding tool in which the shape of the tip ground on the drill is determined by cams which control the depth of cut of the grindstone against the drill tip.

Yet another object of the invention is to provide a drill grinding tool which is simple, robust and economical and which is able to regrind drills of any size within a given range without requiring any adaptation or modification.

SUMMARY OF THE INVENTION

The present invention thus provides a twist drill sharpening tool operable to guide the tip of a drill to be sharpened in contact with the cylindrically curved surface of a grindstone in such a way that the line of contact between the drill tip and the surface of the grindstone extends generally parallel to the axis of the said cylindrical surface and is offset from a diametral plane of the grindstone parallel to the axis of the drill.

The present invention also provides a method of sharpening a twist drill in which the drill is turned solely about its longitudinal axis, with its tip in contact with a grindstone. By contrast with known methods of drill sharpening the method of the present invention and the drill sharpening tool of the present invention each enable the two "lands" of the drill tip to be ground without changing the position of the drill in a drill holder, consequently ensuring that the two "lands" of the drill tip surface are in axial register with one another and both are entirely symmetrical.

The present invention also comprehends a twist drill sharpening tool comprising a body supporting a rotatable grindstone having a cylindrically curved surface, the body having a portion extending transverse the axis of the cylindrically curved surface of the grindstone and having a guide surface formed thereon or on a member carried thereby, and a twist drill holder having means for retaining a twist drill to be sharpened, in such a way that the drill is held against relative movement with respect to the holder both parallel to the axis of the drill and around the axis of the drill, the drill holder having a locating surface for cooperative engagement with said guide surface whereby to limit the axial advance of the drill towards the grindstone in dependence on the relative angular orientation of the drill about its axis with respect to the said body of the tool. When positioned in the tool, therefore, the line of contact between the drill tip and the surface of the grindstone extends generally parallel to the axis of the cylindrical surface of the grindstone axis, and said cutting edge is then offset from a diametral plane of the grindstone parallel to the axis of the drill.

The drill may be held by the drill holder, in the tool body such that the angle between the plane parallel to the axis of the grindstone and containing the drill axis, and the diametral axial plane of the grindstone passing through the point of contact with the drill is in the region of 10°–12°.

The body portion may be a generally cylindrical projection and said guide surfaces are in this case formed on the end thereof and comprise two diametrically opposed recesses separated by raised cam faces which themselves are diametrically opposite one another and orthogonal to recesses. The said body portion has a different form in other embodiments but has the common feature of a bore for receiving the drill holder and one or more cam faces around the mouth of the bore. If two cam faces are provided one raised cam face preferably has a notch defining a shoulder against which a locating member can be engaged to set the drill holder in a predetermined angular orientation about the drill axis with respect to the tool body. Obviously, having established a reference orientation for the drill holder, it is necessary also to establish a reference orientation for the drill within the holder, and although this could be achieved by some form of reference engagement between the drill and the holder it is preferable for the drill reference to be formed on the tool body itself, and for this purpose the tool body may be provided with retractable stop means against which a given part of a twist drill can be located to set the drill in a predetermined angular orientation about its own longitudinal axis with respect to the tool body.

The twist drill retaining means on the drill holder must therefore be capable of being released to an extent sufficient to allow the twist drill to be turned with respect to the holder without entirely releasing the drill.

One form of said releasable clamping means on the drill holder includes a first releasable clamping device operable to exert a first retaining force, and a second retaining force greater than the first. In the preferred embodiment, however, only a single retaining device is required, this being so formed that it can be lightly engaged in order to retain a drill but allow it to be turned or axially moved to set its position, and subsequently to be firmly clamped to retain the drill securely against any displaceing force such as may be exerted on the drill by a grindstone against the face of which the drill tip is contacted in use of the tool.

In the first mentioned embodiment of the tool holder, the first releasable clamping device comprises a plurality of wedge shape elements retained within a sleeve and resilient biasing means urging said elements axially in a first direction such that the wedging inter action between said elements and the sleeve causes a radial inward displacement of the elements to grip a drill within the sleeve. The second releasable clamping device has first and second stable positions, in a first of which a drill is securely retained against displacement and in the second of which the drill is freely movable apart from any retaining force which may be applied by said first clamping means.

The retractable stop means against which the drill is positioned by contact to determine its required angular orientation, preferably comprise a lateral projection from the body having a passage or bore therein along which a slidable abutment element is positioned. This slidable abutment element may have a plain end face against which a cutting edge of the drill tip may be engaged in order to determine the reference orientation, or a more complex shape matching complementarily the shape of one half of the drill tip may be provided.

The procedure for sharpening a drill thus comprises inserting the drill into the tool holder and lightly clamping it in position either by means of said first clamping means or, as in the embodiment described above by lightly engaging the only clamping means. The orientation of the drill in the holder is then set to a predetermined reference orientation.

In one embodiment this is achieved by introducing the tool holder into the bore in the tool body until the drill tip contacts the grindstone or the locating member of the drill holder engages the guide surface of said portion of the tool body depending on the relative axial position of the tool holder and drill held thereby. Because the retention of the drill is only light it can be overcome by a manually applied force to slide the drill with respect to the holder until said locating means are engaged on the guide surface at the same time as the drill tip is in contact with the grindstone.

The retractable stop means are then advanced and, with the tool holder in its reference orientation, abutting a suitable reference abutment if such is provided, the drill is turned with respect to the drill holder until the required angular orientation of the drill is achieved by abutment of, for example, one of the cutting edges against a reference face of the retractable stop means. At this point the retaining means of the drill holder are tightened so that no further relative movement between the drill and the holder can take place. The retractable stop means are retracted and drive is applied to the grindstone to cause this to turn. Finally the drill holder is turned about the longitudinal axis of the drill, the axial advance of the drill holder and drill being limited by the guide surfaces over which said locating member rides, and after one or two rotations the drill tip will have been ground by contact with the rotating grindstone and no further removal of metal will take place, at which stage the sharpening of the drill is complete.

The orientation setting of the drill in the holder may be achieved by means of a drill setting arrangement comprising a setting element having a V-groove defined by two plane faces inclined to one another and meeting along a line perpendicular to the axis of a drill held by the holder with its tip in contact with the two plane faces simultaneously. Although the drill tip is cut to an approximately conical shape, there is a given angular orientation (or rather two such orientations diametrically opposed to one another across a plane of symmetry including the axis of the drill) at which the drill will enter the space between the two inclined faces more deeply than any other orientation. In this angular orientation the two "lands" of the drill tip surface are aligned along the meeting line of the two inclined faces and a straight line joining the shoulder at the radially outer end of a cutting edge to the shoulder at the radially outer end of the triling edge of the opposite land lies in the plane of the face contacted by two such corners. This is a precisely located orientation and can be detected by feel as the drill is turned about its own axis by hand because the drill will advance, as it turns, until it reaches this angular orientation, and then when turned in either direction about its axis will tend to move in the reverse feed direction away from the drill tip.

Thus, by introducing a drill and turning it by hand one way and the other the point of maximum advance can be readily detected allowing the drill holder to be fitted to the drill in a predetermined orientation with relation to the drill body. A suitable recess or hole in the tool body can be provided with two plane inclined faces at its blind end, for example by means of an insert V-block, with appropriate means for angularly locating the drill holder in its reference orientation and for determining the drill extension distance, namely the distance from the drill to the V-block, which determine the amount of material removed upon grinding. This distance can also be adjusted to compensate for drill wear in a simple manner.

The present invention also comprehends a drill sharpening tool in which the body is formed in two separate parts, a first part supporting the said rotatable grindstone and a second part for receiving the tool holder, said second part being angularly movable with respect to said first part whereby to change the drill tip angle ground by the grindstone when the drill held by the holder is in contact therewith.

In a preferred embodiment of invention the said second part is movable between two end positions and located in the end position by suitable locating means. Any selected number of indexed positions between the two end positions may be provided, and it has been found that the majority of materials required to be cut by a drill can be accommodated with drills having one of just two or three drill tip angles, but a tool offering a drill tip angle of 118° and a drill tip angle of 130° has been found to be most useful.

Various other features and advantages of the invention will become apparent from a study of the following description with reference to the accompanying drawings, which is given purely by way of non-limitative example.

DESCRIPTION OF THE PREFERRED EMBODIMENTS

Figure 1:
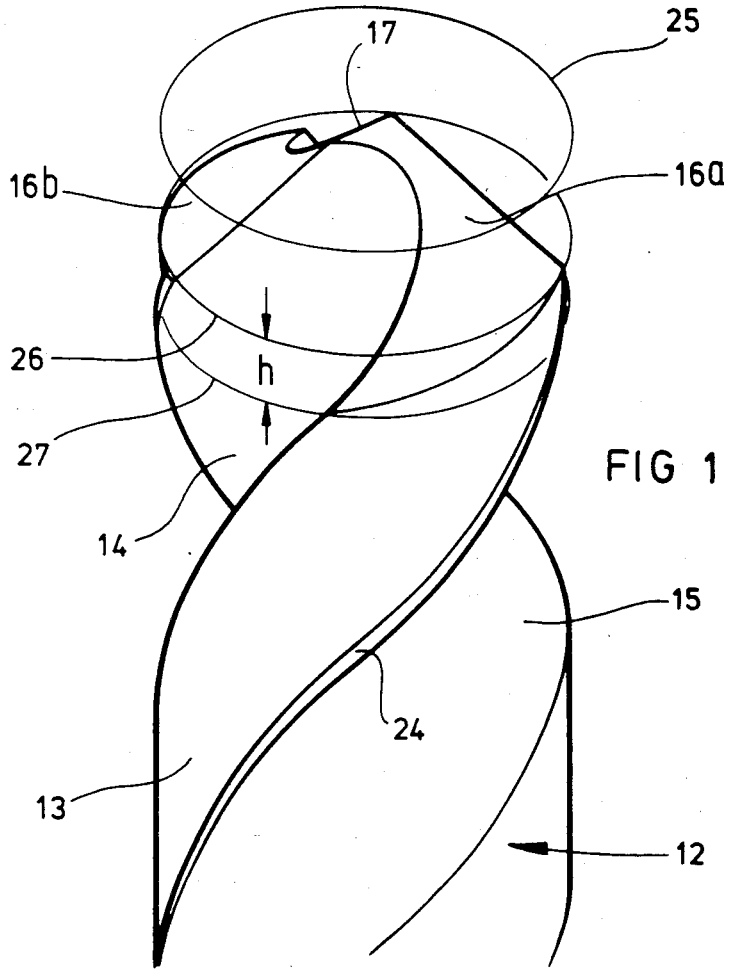
FIG. 1 is a perspective view of a drill tip illustrating the various faces and the way in which a drill has to be sharpened.
Figure 2:
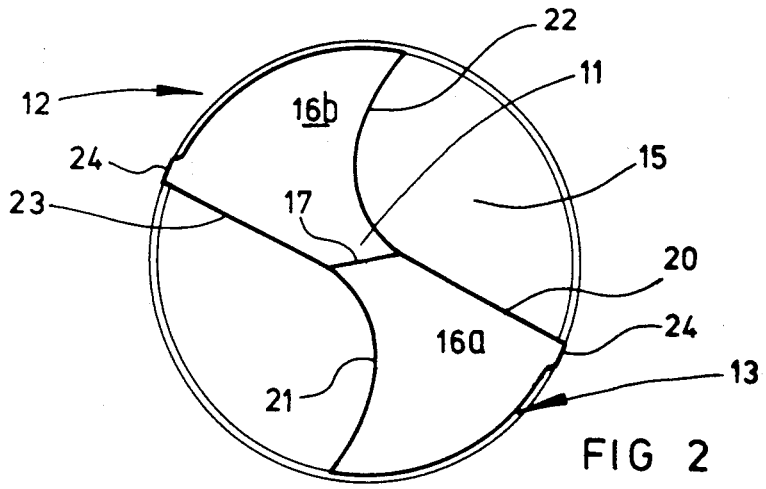
FIG. 2 is an end view of the drill of FIG. 1.

Referring first to FIGS. 1 and 2, the shape of a twist drill is illustrated. This comprises, as known, a central web generally indicated 11 which constitutes the central portion of a twist drill body generally indicated 12 having a cylindrical outer surface 13 in which there are formed two deep helically extending channels generally indicated 14, 15. At its tip the drill is formed with a generally conical end surface 16 separated into two "lands" **16*a*, 16*b* by a crest or ridge 17 in the form of a chisel edge which intersects the longitudinal central axis of the drill body 12**.

Each "land" is identical to the other and consequently only the land **16*a* will be described in detail since this is the most visible in FIG. 1. The twist drill is, in use, rotated about its longidinal central axis in a counter-clockwise direction as viewed in FIG. 2 so that the leading edge of the land 16*a* is the edge between this land and the spiral flute 15, which has been identified with the reference numeral 20. The trailing edge 21 of the land 16*a* meets with the spiral flute 14. As can be seen the leading edge 20 is substantially straight between the point where it meets the chisel edge or ridge 17 and the point where it meets the outer circumference 13 of the drill body 12. This edge 20 continues as an unbroken line from the point of intersection between the chisel edge or tip 17 and the leading edge 20 of the land 16*a* as a curved trailing edge 22 of the land 16*b*. Likewise, the curved trailing edge 21 of the land 16*a* extends from the cylindrical surface 13 of the drill in a continuous curve to the point where it intersects the line of the drill tip chisel edge 17, from which point the edge continues, as a straight line, as the leading edge 23 of the land 16*b*. The two straight leading edges 20, 23** constitute the cutting edges of the drill itself, and these are continued as the helical leading edges of the cylindrical surface 13 where this cylindrical surface meets the flutes 14, 15. A raised "ribbon" of this surface, generally indicated 24 ensures that the cylindrical surface 13 is in face slightly recessed from the hole being formed by the drill to minimize frictional contact.

The precise form of the drill tip is extremely important in relation to the cutting operation to be performed by the drill. In particular the length of the chisel edge 17 in relation to the overall diameter of the drill, which in turn determines the lateral separation of the cutting edges 20, 23 (transverse their length), the inclination of the cutting edges 20, 23 with respect to a transverse diametral plane of the drill tip, identified by the circular plane generally indicated 25 in FIG. 1, and the "fall" or inclination of the lands 16*a*, 16*b* between the leading and trailing edges with respect to a plane orthogonal to the axis of the drill are quite critical. The "fall" is particularly important since it ensures the ability of the cutting edge to pass freely over the blind end of a hole being drilled without undue frictional contact between the drill tip and the hole, thereby ensuring that the cutting edges along contact the work and this can be seen as a separation between the two broken line circles 26, 27 in FIG. 1. In fact, the broken line circle 26 represents a plane perpendicular to the axis of the drill and passing through the point of intersection of the leading edge 20 with the cylindrical surface 13, the so-called "shoulder" of the cutting edge, and the circle 27 represents the corresponding intersection between the trailing edge of the land 16*a* and the surface 13, this "fall" is identified by the axial distanct "h" in FIG. 1.

Although drill tips are accurately formed when new, continuous use eventually blunts the cutting edges and the drill has to be sharpened. This is a highly skilled operation to perform manually since it requuires a close knowledge of all the required parameters of the drill and sufficient experience to know how to hold the drill at the required angle to avoid grinding the lands 16*a* and 16*b* flat, to preserve the chisel edge 17 separating the two lands 16*a* and 16*b*, to maintain this at the correct inclination with respect to the cutting edges 20, 23 and at the same time to preserve the inclination of the "fall" with respect to the perpendicular planes 26, 27.

All these things can be achieved automatically using the drill sharpening tool of the present invention without requiring any skill and without being dependent on any particular drill size. The two embodiments illustrated in FIGS. 3, 4 and 5 differ only in the mechanism for setting a drill in the required preliminary position, and components which fulfill the same or similar functions in the two embodiments will be referred to with the same reference numerals.

The tool is formed as two separate cooperating parts, comprising a drill holder 28 and a grindstone holder 29. The latter comprises a body 30 generally composed of two interpenetrating cylindrical body portions 31, 32 each of which has a respective cylindrical cavity 33, 34 which communicate with each other. The cylindrical cavity 34 in the body portion 32 is enlarged by a lateral trapezoidal section chamber 35 on the side nearest the cylindrical body portion 31.

One end of the cylindrical bore 34 carries a bearing (not shown) within which runs a spindle 36 carrying a cylindrical grindstone 37. The bearing (not shown) incorporates suitable dust and grit seals for the purpose of retaining any grinding dross within the chamber constituted by the bore 34 and trapezoidal extension 35. The spindle 36 may be fitted with a drive pulley for connection to an electric motor, or can be gripped by the chuck of a conventional electrical pistol drill of the widely available and well known type, not shown in the drawings.

The drill holder 28 has a generally cylindrical body 38 with a cylindrical bore 39 extending axially therethrough and a radial flange 40 at one end. The cylindrical outer periphery of the flange 40 is threaded and receives the internally threaded skirt 41 of a cap 42 having a central axial bore 43 which passes through the body of the cap 42 and through a central axial boss 44 formed on the inside face of the cap 42. The bore 43 has a conically tapered end portion 45 where it passes through the boss 44. The diameter of the boss 44 is such that it forms a sliding fit within a laterally enlarged end portion 46 of the bore 39 within the cylindrical body 38 of the tool holder. The opposite end of the bore 39 from the laterally enlarged portion 46 also has a conically tapered end portion 47, both of these tapers having a cone angle of 20°, that is an angle of inclination of 20° between the axis and a generatrix of the conical surface. At the upper end of the holder and passing through the enlarged portion 46 are two diametrically opposed axial grooves in the wall of the bore 39, identified with the reference numeral 51. These recesses or grooves 51 receive respective diametrically opposed projections of a resilient insert shown separately in FIG. 6, and comprising a cylindrical body 48 having conically tapered ends 49, 150 with a cone angle of 10° and of a length such as to fit closely between the conically tapered parts 47,45 of the bore 39 and the bore 43 in the cap 42 respectively. Each of the conically tapered end portions 49, 150 of the body 48 has a plurality of axial slots 52, say four or five, so that the conically tapered end portions 49, 150 can be resiliently closed in the manner of a drill chuck, by relative approaching movement of the body 38 and the cap 42 effected by screwing the cap 42 with respect to the body 38 on the screw threads of the flange 40 and cooperating skirt 41. The cylindrical body 48 is normally loosely fitted in the bore 39 and a drill, such as the drill 53 illustrated in FIG. 4 can be positioned within it by introducing it into the bore 43 in the cap 42 and pushing it through the bore 39 in the body 38. Then by relatively turning the cap 42 and the body 38 a light pressure can be applied to the drill 53 to retain it in position whilst the body 38 of the drill holder 28 is fitted into the bore 33 in the cylindrical body portion 30 of the grindstone holder 29 part of the tool.

Figure 4:
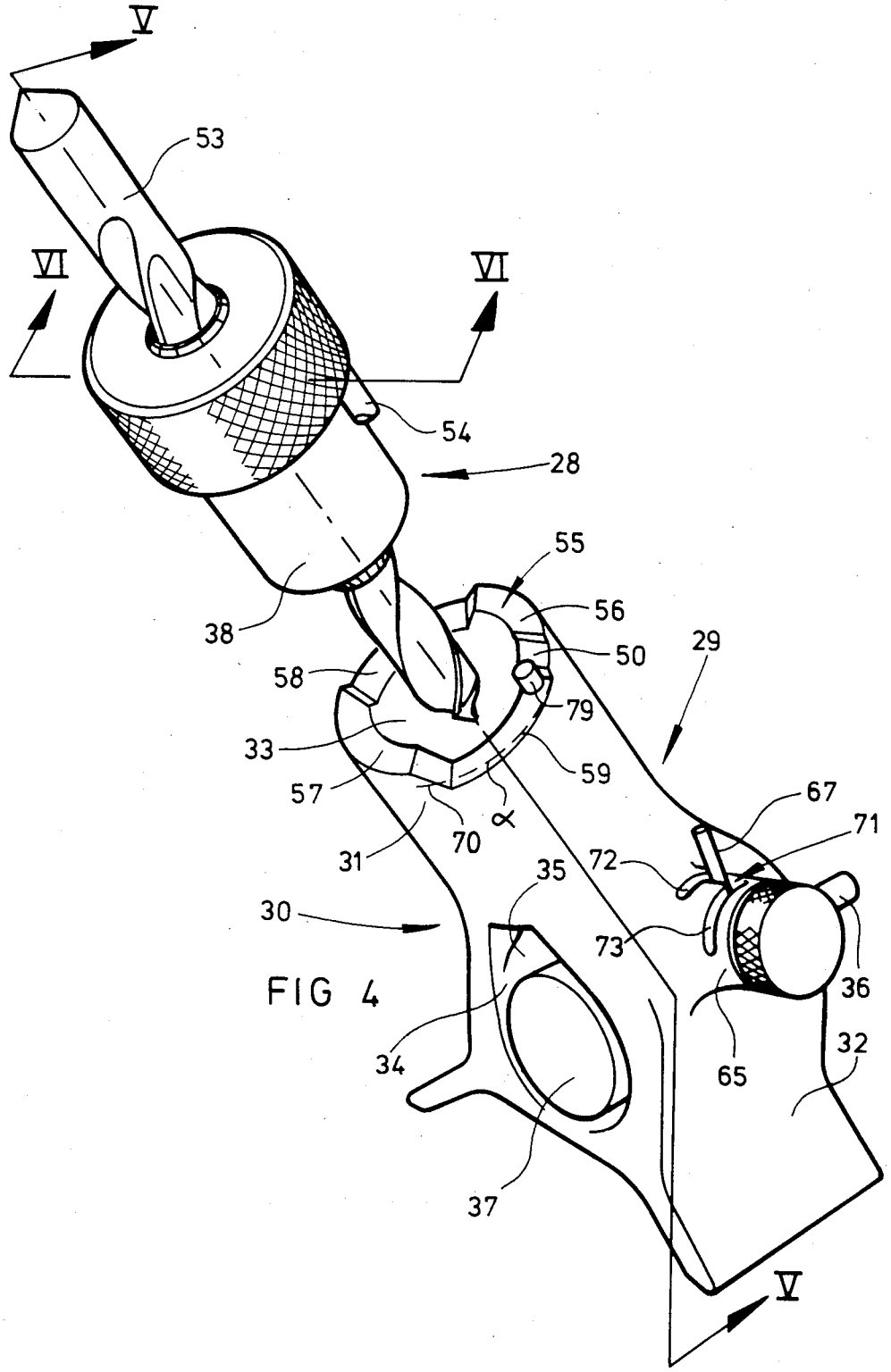
FIG. 4 is a perspective view from the front end side of a second embodiment of the invention.

The drill holder 28 has one further component of importance, namely a locating projection 54 which extends axially from the flange 40 and lies closely alongside the outer cylindrical surface of the body portion 38. The locating projection 54 contacts the annular cylindrical end surface generally indicated 55 of the cylindrical portion 31 of the grindstone holder 29. This annular end surface 55 has two diametrically opposed "lands" 56, 57 separated by two, likewise diametrically opposed, recesses 58, 59 which, as can be seen in FIG. 4, are not perpendicular to the axis of the cylindrical portion 31 but are inclined at an angle $\alpha$ to such perpendicular plane as illustrated by the broken line 70 of FIG. 4.

This angle $\alpha$ determined the "fall" of the lands 56, 57 as the drill tip is turned in contact with the cylindrical surface of the grindstone 37, for which purpose the drill holder 28 is introduced into the cylindrical bore 33 in the body portion 30 of the tool.

Figure 3:
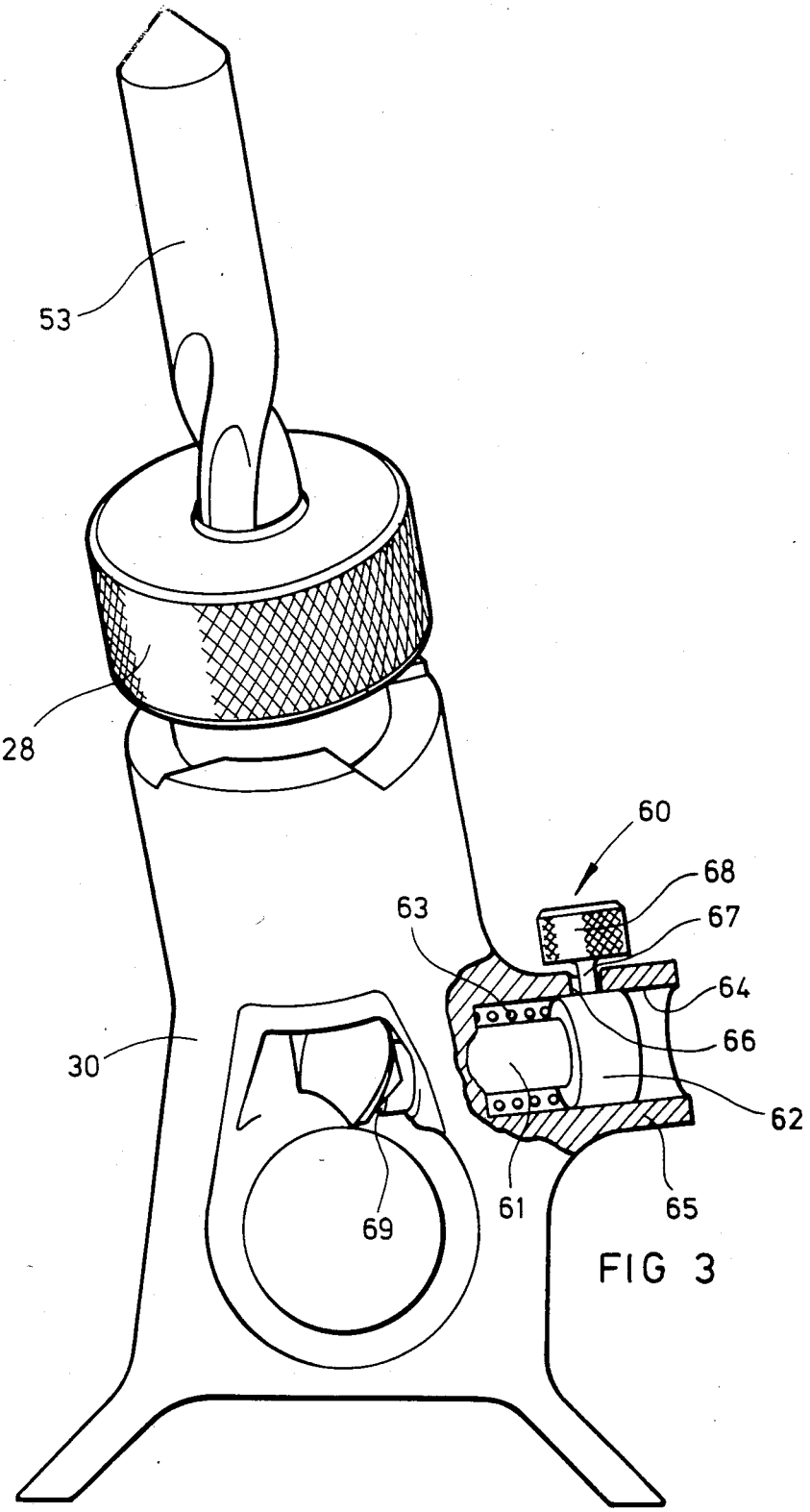
FIG. 3 is a front view of a first embodiment of the invention.

Obviously, the relative angular orientation of the drill 53 and the drill holder 28 is critical to the proper operation of the tool and this is achieved by means of a settling device generally indicated 60 in the embodiment of FIGS. 3' 4 and 5.

The drill settling device 60 in the embodiment of FIG. 3 is simply constituted by a cylindrical bolt 61 having an enlarged head 62 and surrounded by a helical spring 63 within a bore 64 in a laterial projection 65 of the tool body 30. This projection 65 has an L-shape slot 66 through which projects a pin 67 secured tot he enlarged head 62 of the bolt 61 and carrying a knurled finger grip 68. The coil spring 63 urges the bolt 61 to the right as viewed in FIG. 3 and the force exerted by this spring 63 can be overcome by displacing the finger grip 68 to the left as viewed in FIG. 3 and engaging it in the foot of the L-shape slot 66, in which position the bolt 61 is advanced as shown in FIG. 3 so that its end face 69 forms a reference surface against which a cutting edge of the drill tip can be engaged to determine the angular orientation of the drill 53 with respect to the tool body 30. If the drill holder 28 is then turned to a reference orientation, for example identified by cooperating marks on the body 30 and the drill holder 28 the tool will be set up in the required position.

Figure 5:
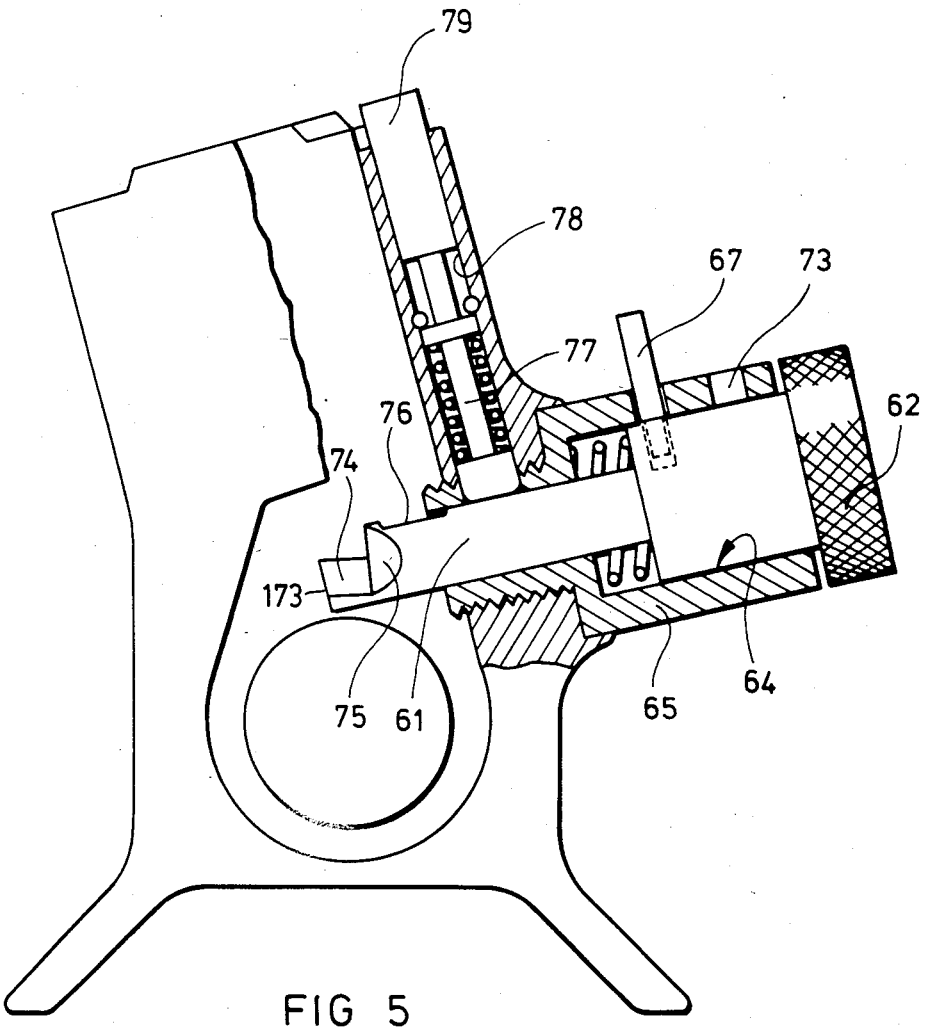
FIG. 5 is a partly sectioned front view taken on the line V—V of FIG. 4.

The embodiment of FIGS. 4 and 5 is an improvement on this arrangement in that the projection 65, conveniently formed as an insert, has a generally U-shape slot 71 having two circumferentially extending arms 72, 73, and within the bore 64 of the projection 65 is housed a shaped bolt 61 having a notch 74 at the inner end, an inclined shoulder 75 and a recessed cam face 76 which engages a cam follower 77 housed in a bore 78 extending axially of the cylindrical portion 30. The cam follower 77 has an upper free end 79 which can project from the annular end face of the tool body coincident with one of the recesses 59 and closely adjacent one end of this recess 59.

As will be seen from FIG. 4 the circumferential arm 73 of the slot 71 is longer than the arm 72 so that when the pin 67 is engaged therein the adjacent end of the cam follower 77 is lodged in the recess constituting the cam face 76. When the pin 67 is displaced circumferentially to engage the axial part of the slot 71, and whilst it is in the arm 72, the bolt 73 is turned so that the cam follower 77 rises up the cam face 76 and engages on the cylindrically curved surface of the bolt 73 thereby causing the free end 79 of the cam follower 77 to project from the recess 59 in the annular end face of the cylindrical portion 31 of the tool body 30. Adjacent this point in the recess 59 is a notch 50 which, together with the projecting end face of the cam follower 79 constitutes a seat for the locating projection 54 of the tool holder 28. This then automatically defines the reference position of the tool holder 28 for setting the drill in its required angular orientation. The notch 74 of the bolt 73, together with the inclined shoulder 75, makes close contact with the end of the drill, being largely complementary in shape. Once the drill has been set in its required angular orientation the bolt 73 is withdrawn, the cam follower 77 is lowered so that the end face 79 now becomes flush with the recessed surface 59 and the sharpening operation can proceed as before by rotating the spindle 36 and turning the drill holder 28 until the tip of the drill has been ground away sufficiently for the locating member 54 to be in contact with the annular end face 55 of the cylindrical portion 31 of the body 30 over the whole of its circumferential travel.

Figure 6:
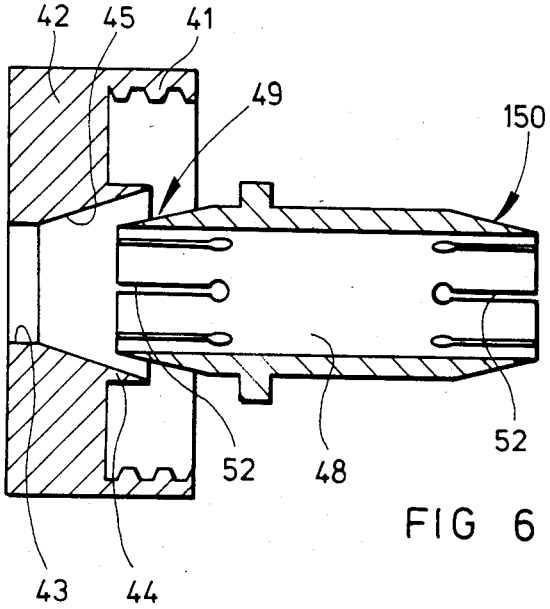
FIG. 6 is a partly sectioned exploded view taken on the line VI—VI of FIG. 4 of one form of drill holder for the tool of the present invention.
Figure 7:
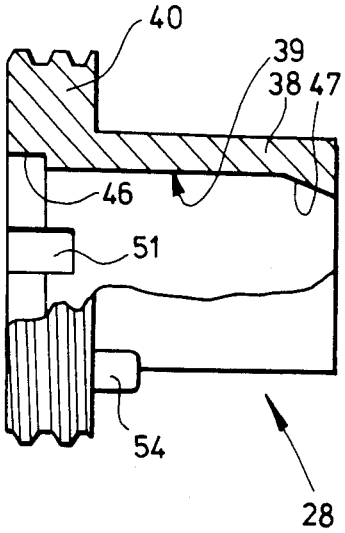
FIG. 7 is a perspective view of a component of the embodiment of FIGS. 4, 5 and 6.
Figure 7:
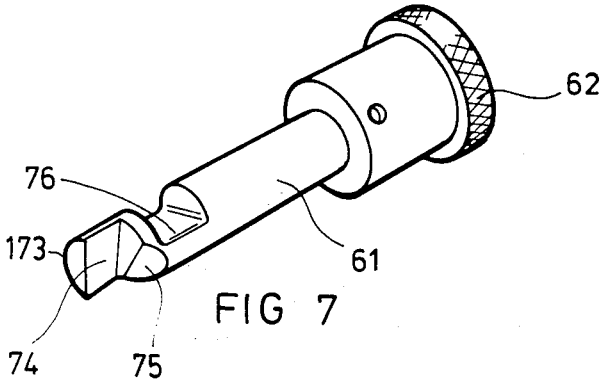

The dimensions of the body 48 of the insert illustrated in FIG. 6 are such that the resilient fingers formed between the slots 52 can be displaced radially between a position, when radially compressed to the maximum extent, such as to grip a drill of about one-quarter inch to a position where, at the maximum or almost to the maximum relaxed state, a drill of about half an inch diameter can be accommodated. To accomodate smaller drills an insert having a thicker wall and, perhaps, larger slots 52 (larger, that is, in the circumferential direction) enabling the fingers to be moved to a smaller radius gripping position could be employed. In order to be able to sharpen extremely fine drills a secondary insert, capable of being fitted into the insert illustrated in FIG. 6, and having a greater axial length such as to support a very fine drill closer to its tip and nearer to the grindstone 37 could be provided.

In a further modification, adapted to be able to accommodate twist drills having different cutting angles (that is the angle between the drill axis and the cutting edge measured through a diametral plane of the drill) could be provided. For this purpose the spindle 36 must be releasably held in the bearing in the body of the stone holder 30 so that grinstones 37 having a different form can be interchangeably fitted. Thus, for example, instead of having a right cylindrical surface, a grindstone having a conical surface can be fitted to the tool so that, together with the combination of angles which can be seen from FIGS. 3, 4 and 5, enables the use of different drill grinding angles. A set of stones 37 having cone angles differing by, say, five degress from one another, is envisaged.

Figure 10:
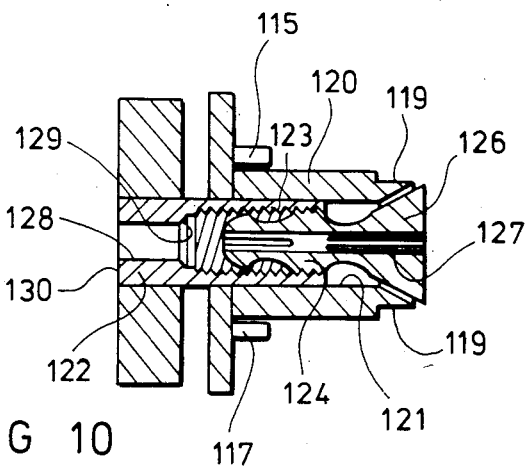
FIG. 10 is a sectional view of a tool holder adapted for gripping small drills.
Figure 8:
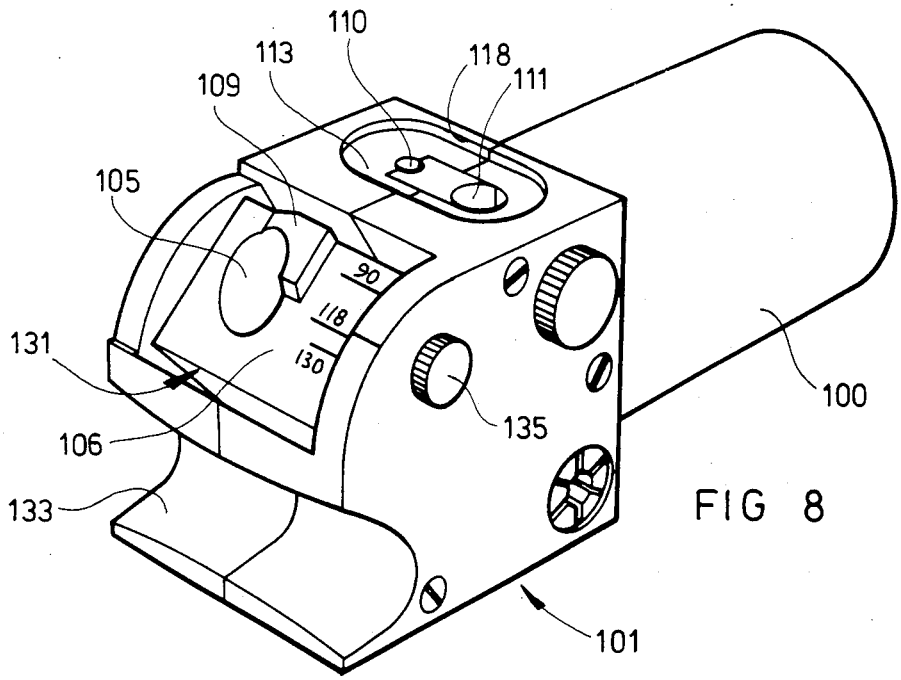
FIG. 8 is a perspective view of a further embodiment of the invention.
Figure 9:
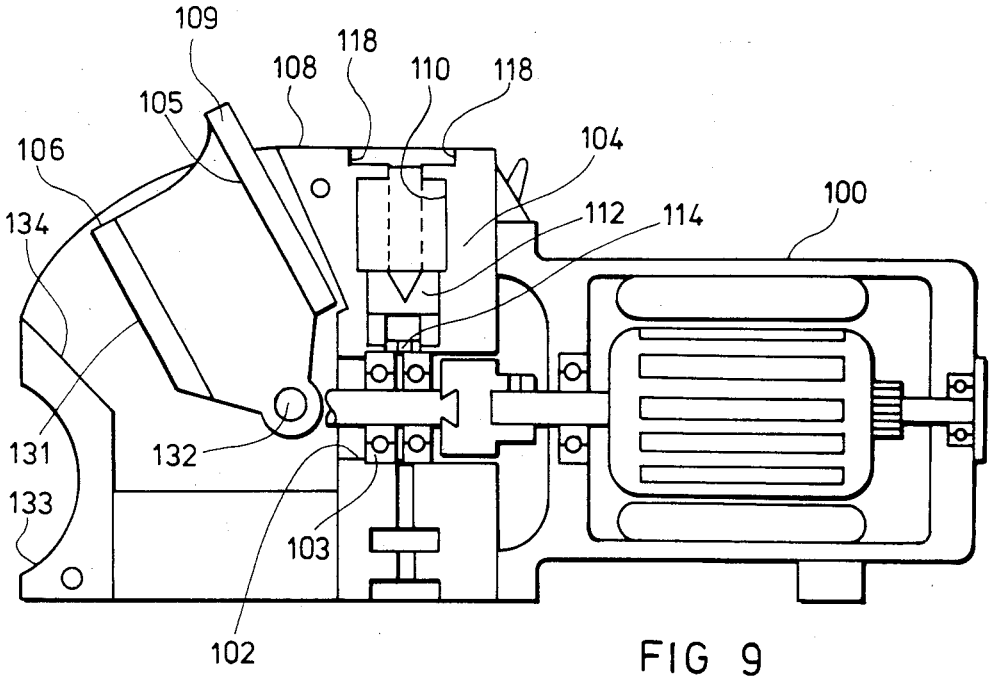
FIG. 9 is a section taken on the line IX—IX of FIG. 8.

The embodiment of FIGS. 8, 9 and 10 also allows adjustments to be made to change the angle at which the drill tip is ground, but in this latter embodiment the change can be effected with great ease and simplicity.

Referring first to FIGS. 8 and 9 the tool shown comprises a solid block body generally indicated 101 having an axial hole 102 therein for receiving a cylindrical grindstone (not illustrated) mounted on a spindle carried by bearings 103 supported on a back wall 104 of the body 101. The spindle is the output shaft of an electric motor 100 also carried by the back wall 104.

Figure 11:
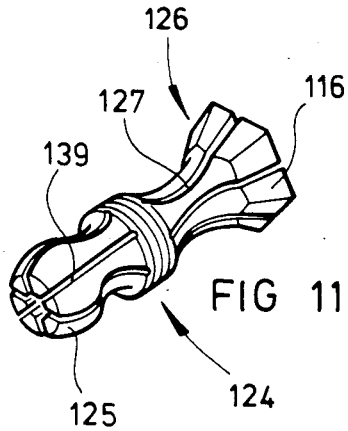
FIG. 11 is a perspective view of a collet insert for the tool holder illustrated in FIG. 10.

The body 101 is formed in two parts, namely a main body part 133 and a drill holder guide part 131. A guide hole 105 which as in the previous embodiment is inclined in two planes, provides guidance and location for a drill holder (not shown) which may be substantially the same as that described in the earlier embodiments or as shown in FIGS. 10 and 11 and described below. The guide hole 105 is formed in a drill holder guide part 131 of the body 101, which is pivotally mounted at 132 to the main body part 133. The drill holder guide part 131 of the body 101 is located within an elongate opening 134 in the main body part 133 which is larger than the outer diameter of the drill holder guide part 131 allowing it to rock about the pivot 132 between two terminal positions defined by contact of the drill holder guide part 131 with opposite faces of the hole 134. The side wall of the main body portion 133 has an aperture through which passes a locating pin 135 which can engage in one of a set of corresponding holes (not shown) in the guide holder body part 131 to locate it at a selected angle. These are marked on the upper face with guide lines indicated with the drill tip angle to be ground. In FIG. 6 the lines are marked 90°, 118° and 130°.

The upper face 106 of the guide holder body part 131 has guide surfaces 109 in the form of a single raised face cam for determining the longitudinal advance of the drill upon rotation of a drill holder such as that shown in FIGS. 10 and 11 holding the drill in alignment with the inclined guide hole 105.

In the horizontal upper face 108 of the main body part 133 are formed two holes 110, 111 housing respective V-blocks 112 located in a predetermined angular orientation by means of a flat on at least one face, and secured in position by means of screws 114 extending up from the bottom face of the body and which serve to adjust the height of the V-blocks 112 in relation to the horizontal face 108 of the main body part 133. As the stone wears the screw 114 can be turned to lower the V block 112 and increase the set length of the drill. The two holes 110, 111 are identical to one another except for diametral size, the latter being larger to accommodate drills of a larger diameter. Hereinafter only the hole 110 will be described in further detail, it being understood that the details of the hole 111 will be identical.

The two holes 110, 111 are formed at the bottom of an oval recess 113 the function of which is to provide two opposite shoulders 118 against which engage flats 119 in the drill holder body to determine the angular orientation thereof when it is fitted in the recess 113.

It can be seen that in relation to the earlier embodiments described, the embodiment of FIGS. 8 and 9 comprises a regular and easily formed body in place of the shaped body previously provided and the complex setting device has been very much simplified. Drill setting in the holder will be described in more detail below.

Referring now to FIGS. 10 and 11, there is shown a drill holder which can be used even for very small drills, comprising a sleeve 120 having a plain bore 121 into which is fitted a control body 122 which has an internal bore passing right through and comprising three portions a first portion 123 which is threaded, a second portion 129 which is tapered and a plain bore third portion 128 which opens into an end face 130 of the control body 122. The threaded shank of a gripper element 124 is screwed into the threaded portion 123 of the bore in the control body 122, and this gripper element 124 has a tapered end 125 matching that of the tapered portion 129 of the bore. The end of the gripper element remote from the tapered end 125 comprises a conically outwardly flared or tapered block 126 having a plurality of elongate slots 127 which extend from the flared end 126 to about mid-way along its length. The flared end 126 has six flat faces 116 so positioned that each is bisected by a longitudinal slot 127. A second set of slots 139 extends from the tapered end 125 to a point closely adjacent the ends of the slots 127. As the control body 122 is turned in relation to the sleeve 120 it draws the gripper body element 124 axially by the screw threaded connection. The flared end 126 is held from turning by the flats 116 and is caused to flex inwardly, such flexure being allowed by the slots 127, to grip a drill positioned therein. At the same time, contact between the tapered end 125 of the gripper element 124 and the correspondingly tapered intermediate portion 129 of the bore 121 in the control body 122 causes the tapered end 125 to flex inwardly closing the slots 139 and gripping the shank of a drill in the holder at a point axially spaced from the flared end 126 so that no rocking of the drill with respect to the holder can take place.

This embodiment of the invention is used as follows: First a drill is fitted into the holder as described above and the control body 122 turned with respect to the sleeve 120 until the drill is lightly gripped. Then the holder is fitted into the oral recess 113 with the flats 119 on the sleeve 120 in contact with the side walls 118 of the recess, which define abutment shoulders to determined the orientation of the holder. The drill, only being lightly gripped, can be pushed into the hole 110 or 111 as appropriate until its tip contacts the V-block 112. Then by turning the drill one way or the other a position of maximum penetration can be felt defining the required orientations of the drill. The control body 122 is then turned to firmly clamp the drill, the holder removed from the recess 113 and fitted to the bore 105. The stone is set in motion and the drill holder turned with its guide pegs 115, 117 successively contacting the cam face 109 to control the axial position of the drill as it is turned. The tip is ground by contact with the stone until no more metal is worn away and is then sharp. The shape of the cam 109 is chosen with a convex curvature such that the required curvature of the drill tip faces **16*a*, 16*b* is obtained. The shape of this curve is the same for drills of all sizes and is unchanged regardless of the drill tip angle so no change to the cam profile is required when the drill holder part 131** of the body is moved to a different position to change the drill tip angle.

In another embodiment (not shown) provision is made for sharpening masonry drills having a hardened tungsten carbide or other hard insert as well as for steel twist drills. This adaptation, based on the embodiment of FIGS. 8 and 9, includes a different tool holder which, with the drill holder guide part 131 moved to a special position, lower than the 130 position illustrated in FIG. 8, enables the tip of the drill to be ground against the flat end face of the stone instead of the curved surface of the stone which is used for twist drills. In this arrangement it is unnecessary to turn the drill about its own axis since the sharpening process involves grinding flats at an angle on the end face of the drill so the drill is merely advanced until it contacts the end face of the stone and then turned through 180° to grind the other side of the tip.

What is claimed is:

1. A twist drill sharpening tool comprising:

a structure supporting a rotatable grindstone having a cylindrically curved surface, said structure including a body having a body portion extending transversely of the axis of said cylindrically curved surface of said grindstone, a first fixed guide surface on one of said body and a member carried thereby, a twist drill holder having a longitudinal axis and including retainer means for retaining a twist drill firmly with its axis parallel to said twist drill holder longitudinal axis against relative movement with respect to said holder both parallel to the axis of said drill and around the axis of said drill, drill position setting means for determining the angular orientation of a twist drill in said twist drill holder whereby to set a twist drill with its tip projecting a predetermined distance from said twist drill holder and in a predetermined angular orientation about its longitudinal axis with respect to said twist drill holder, a second fixed guide surface on said drill holder for cooperative engagement with said first fixed guide surface whereby to control the advance of said drill in a direction parallel to its own axis towards said grindstone in dependence only on the relative angular orientation of said twist drill holder about its axis with respect to said body of said tool, a third fixed guide surface on said body and, a fourth fixed guide surface on said drill holder, said fourth fixed guide surface cooperatively engaging said third fixed guide surface whereby to retain said drill holder and said twist drill carried thereby with its axis in a predetermined angular orientation with respect to the axis of said grindstone and non-adjustably fixed against turning movement about any axis transverse said twist drill holder longitudinal axis whilst allowing said drill holder and said twist drill carried thereby to turn about said longitudinal axis of said twist drill and to be displaced parallel to said longitudinal axis of said twist drill by said cooperative engagement of said first and second fixed guide surfaces whereby to determine the shape of the tip ground on said twist drill, said cooperative engagement of said third and fourth fixed guide surfaces locating said drill holder such that a drill held thereby lies in a plane inclined at a predetermined angle with respect to a plane perpendicular to the axis of the cylindrical surface of said grindstone and is retained with the line of contact between the cutting edges of the drill tip and the cylindrical surface of the grindstone extending generally parallel to the axis of said cylindrical surface and off-set by a predetermined non-adjustable distance from a diametral plane of said grindstone parallel to the axis of said drill, whereby sharpening of the drill is effected solely by rotation of the said drill holder about the axis of the drill held thereby.

2. The twist drill sharpening tool of claim 1, wherein said body portion projects from said body and said first guide surface is formed on an end face of said projecting portion.

3. The drill sharpening tool of claim 2, wherein said third guide surface is a generally cylindrical bore in said body portion for receiving said drill holder, and said first guide surface is formed on an end face of said body portion and comprises at least one raised cam face for displaceing the cooperating said second guide surface axially of said bore as said drill holder is turned about the bore axis.

4. The drill sharpening tool of claim 3, wherein said cam surface has a notch defining a shoulder against which said second guide surface can be engaged to set said drill holder in a predetermined angular orientation about the drill axis with respect to said tool body.

5. The drill sharpening tool of claim 1, wherein said tool body has a drill tip abutment means against which a given part of a twist drill tip can be located to set said drill in a predetermined angular orientation about its own longitudinal axis with respect to the tool body.

6. The drill sharpening tool of claim 1, wherein said twist drill retaining means on said drill holder include releasable clamping means.

7. The drill sharpening tool of claim 1, wherein there are provided means for setting the angular orientation of said drill about its own axis with respect to said drill holder of said tool, in which said means for setting said angular orientation of said drill comprise a drill setting member having two generally plane faces inclined to one another and meeting along a line perpendicular to the axis of said drill held by said holder with its tip in contact with said two plane faces simultaneously.

8. The drill sharpening tool of claim 1, wherein said body is formed in two parts comprising a first part having means for supporting said grindstone for rotation about its axis and a second part having means for receiving and supporting said tool holder such that said tip of said drill is in contact with said grindstone, said second part being angularly displaceable with respect to said first part about an axis orthogonal to the axis of said grindstone between at least two positions whereby to vary said drill tip angle ground in use of said tool.

9. The drill sharpening tool of claim 8, wherein said second part of said tool body is displaceable between three predetermined positions about said axis whereby to adapt said tool for grinding drills having one of three different drill tip angles.

10. The drill sharpening tool of claim 1, wherein there are provided means for varying the length of projection of said drill from said drill holder whereby to compensate for wear on said grindstone after a period of use.

11. The drill sharpening tool of claim 1, wherein said drill holder comprises a sleeve having an axial bore with an outwardly flared mouth portion at one end thereof, a clamping collet member having a correspondingly outwardly flared end portion, means defining a hollow axial bore in said clamping collet member, and means defining a plurality of diametral slots extending part way along said hollow axial bore in said clamping collet member, and a screw control member having a screw threaded bore into which the other end of said clamping collet can be threadedly engaged and which fits into the other end of said bore in said sleeve.

12. The drill sharpening tool of claim 11, wherein said bore in said screw control member has a tapered portion adjacent its end opposite that into which said clamping collet screws, and said clamping collet has a tapered outer portion which cooperatively engages said tapered portion in said screw control member such that as said screw control member and said clamping collet are screwed together said sleeve abuts said shoulder and said clamping collet is drawn into it so as to be compressed radially by said tapered portions at each end thereof.

13. The drill sharpening tool of claim 1, wherein said grindstone is mounted on a spindle turnable in bearings carried by said tool body and projecting therefrom for attachment to a coupling of drive means such as a pistol drill.

14. The drill sharpening tool of claim 1, wherein said grindstone is mounted on a spindle turnable in bearings carried by said tool body and connected to a drive motor also carried by or attached to said tool body.

15. A twist drill sharpener comprising a rotary grinding wheel having a cylindrically curved grinding surface and a grinding wheel axis, grinding wheel support means rotatably supporting said rotary grinding wheel for rotation about said grinding wheel axis, a drill sharpener body housing said grinding wheel support means, drill holder means having a longitudinal axis, a first end and means for gripping a twist drill and holding it fixedly with the drill axis parallel to said longitudinal axis of said drill holder means, at least one cam guide surface on said drill holder means, twist drill position setting means for determining both the relative angular orientation of a twist drill with respect to said drill holder means and the distance by which the tip of a twist drill projects from said first end of said drill holder means, drill holder receiving means for receiving said drill holder means with said first end thereof facing towards said rotary grinding wheel, an internal fixed guide surface of said drill holder receiving means guiding said drill holder means to rotate about its own longitudinal axis, means pivotally mounting said drill holder receiving means in said drill sharpener body for turning movement about an axis orthogonally intersecting said grinding wheel axis, drill tip angle setting means for fixing said drill holder receiving means in a selected angular orientation about said axis orthogonally intersecing said grinding wheel axis, fixed cam guide surfaces on said drill holder receiving means engageable by said at least one cam guide surface on said drill holder means to cause said drill holder means to reciprocate longitudinally a predetermined axial distance as it is turned about its longitudinal axis, said internal fixed guide surface cooperating with said drill holder means to position a twist drill held by said drill holder means in a position determined by said twist drill position setting means and said drill tip angle setting means, such that its axis lies at an angle to said grinding wheel axis determined by the required drill tip angle to be ground, and further lies at an angle to the diametral axial plane of said grinding wheel passing through the line of contact between said drill and said grinding wheel whereby upon turning said drill holder means about its axis guided by said internal fixed guide surface of said drill holder receiving means the tip of said twist drill held thereby is sharpened and ground with a chisel edge and a heel clearance while being retained with its axis fixed in relation to said grinding wheel axis.

16. A twist drill sharpening tool comprising:

a housing, a grindstone having an axis and a cylindrical outer surface, means for rotatably mounting said grindstone to said housing around said grindstone axis, said housing having a body which extends transversely outwardly from the axis of the grindstone, means for fixing said body against movement with respect to said housing during a sharpening operation, said body having a cylindrical throughbore, said body throughbore having a fixed axis during said sharpening operation which is inclined at a predetermined angle with respect to a plane perpendicular to the grindstone axis and which is also parallel but spaced from a diametral plane of the grindstone axis, a drill holder having an axis and an outer cylindrical surface with substantially the same diameter as said body throughbore so that said tool holder is axially slidably and rotatably received in said body throughbore but constrained against transverse movement with respect to said body, said drill holder having a coaxial throughbore, means contained within the drill holder throughbore for releasably holding a twist drill against both rotatable and axial movement with respect to said tool holder and so that the twist drill protrudes outwardly from an end of the drill holder adjacent the grindstone, a first cam surface on said body, a second cam surface on said drill holder which cooperates with said first cam surface to axially displace said drill holder upon rotation of said drill holder and in an amount dependent upon the angular rotational position of said drill holder, wherein sharpening of a drill held by said drill holder is completely effected solely by rotation of said drill holder in said body throughbore coupled with the axial displacement of said drill holder caused by coaction between said cam surfaces but without transverse movement of said drill holder with respect to the axis of the grindstone.

* * * * *